United States Patent [19]

Satake

[11] Patent Number: 4,896,592

[45] Date of Patent: Jan. 30, 1990

[54] GRAIN POLISHING MACHINE

[75] Inventor: Toshihiko Satake, Higashihiroshima, Japan

[73] Assignee: Satake Engineering Co., Ltd., Tokyo, Japan

[21] Appl. No.: 311,620

[22] Filed: Feb. 15, 1989

[30] Foreign Application Priority Data

Mar. 31, 1988 [JP] Japan ..... 63-81669

[51] Int. Cl.[4] ..... B02B 3/04; B02B 3/06

[52] U.S. Cl. ..... 99/519; 99/524; 99/528; 99/605; 99/610; 99/618

[58] Field of Search ..... 99/518, 519, 523, 522, 99/524, 568, 571, 574–576, 579–582, 600–602, 605–611, 617–622, 528, 612–614; 241/244–246, 73, 239; 426/482, 483

[56] References Cited

U.S. PATENT DOCUMENTS

| | | | |
|---|---|---|---|
| 775,098 | 11/1904 | Welch | 99/614 |
| 777,986 | 12/1904 | Welch | 99/614 |
| 3,485,280 | 12/1969 | Satake | 99/614 |
| 3,734,752 | 5/1973 | Headley | 99/524 |
| 3,960,068 | 6/1976 | Salete | 99/606 |
| 4,426,922 | 1/1984 | Yamamoto | 99/519 |
| 4,459,903 | 7/1984 | Yamamoto | 99/605 |

*Primary Examiner*—Timothy F. Simone
*Attorney, Agent, or Firm*—Darby & Darby

[57] ABSTRACT

A grain polishing machine of a vertical shaft and friction type in which a vertical polishing rotor and a bran removing polishing cylinder surrounding the former have each different diameters so as to have step parts dividing a polishing chamber defined between the polishing rotor and the polishing cylinder into a plurality of parts which are communicated with each other through connection passages that are defined between the step parts of the polishing rotor and the polishing cylinder thereby to prevent the weight of grain in the upper part of the polishing chamber from affecting the polishing pressure in the lower part thereof so that the polishing pressure in the polishing chamber is made to be uniform as a whole.

7 Claims, 5 Drawing Sheets

GRAIN POLISHING MACHINE

BACKGROUND OF THE INVENTION

The present invention relates to a vertical shaft and friction type grain polishing machine in which grain particles are supplied into a polishing chamber from one end thereof and polished grain particles are discharged from the other end of the polishing chamber.

DESCRIPTION OF THE PRIOR ART

FIG. 1 is a sectional view of a known polishing machine of vertical shaft and friction type. Grain particles are supplied from a grain supplying section (not shown) to a grain feeding chamber 102 formed around a spiral rotor 101 fixed to a main shaft 109. The spiral rotor 101 feeds the grain particles into a polishing chamber 105 which is defined by a friction polishing roller 103 and a bran removing polishing cylinder 104 having a perforated wall. The grain particles are polished by the frictional polishing effect produced by the frictional polishing roller 103 and the thus polished grain particles are discharged to the outside of the machine through a grain discharge section 106 overcoming the pressure produced by a pressing plate 107. Fine dust such as bran produced as a result of the polishing performed in the polishing chamber is carried by air blown from elongated slots 108 to the exterior of the machine through the perforations in the perforated wall of the bran removing polishing cylinder 104 and past the bran removing chamber (not shown).

This known grin polishing machine of vertical shaft and friction type, however, is disadvantageous in that insufficient agitation and mixture of grain particles take place because the pressure is uniformly applied to the grain particles in the polishing chamber 105 in the direction of the axis of the vertical shaft. In consequence, it is experienced that a part of grain particles are discharged before they are satisfactorily polished, resulting in a non-uniform polishing of the grain. In this known grain polishing machine, although a resistance pressure posed on the grain particles in the machine can be increased by means of a pressing plate which is controlled by a resistance control device, such increase does not provide any appreciable effect in the polishing because grain particles do not revolve so as to make friction among grain particles null, and only the grain temperature rises at most. Thus, the known grain polishing machine of vertical shaft and friction type could provide only a low polishing efficiency and yield of the polished grain.

SUMMARY OF THE INVENTION

Accordingly, an object of the present invention is to provide a vertical shaft and friction type grain polishing machine which is capable of imparting sufficient agitating and mixing effects to grain particles so as to avoid variation in polishing of grain particles thus preventing polishing efficiency and yield from decreasing, thereby to overcome the above-described problems of the prior art.

According to a first aspect of the present invention, there is provided a grain polishing machine of vertical shaft and friction type comprising: a vertical perforated bran removing polishing cylinder, a main shaft rotatably mounted in said cylinder, and a spiral rotor and a polishing rotor mounted by said main shaft for rotation therewith, said polishing rotor having agitating projections, said perforated bran removing polishing cylinder and said polishing rotor cooperating with each other to define a polishing chamber therebetween which is communicated with a grain feed section and a grain discharge section at its one and other corresponding chamber ends, wherein each of the perforated bran removing polishing cylinder and said polishing rotor is composed of a plurality of portions having different diameters.

According to a second aspect of the invention, the grain feed section is formed at the lower end of the polishing chamber.

According to a third aspect of the present invention, the grain feed section is connected to a feed chamber and a grain supply device for compulsorily feeding the grain particles is connected to the grain feed section.

According to a fourth aspect of the present invention, a resistance adjusting means capable of adjusting the cross-sectional area of the space between the polishing rotor and the polishing cylinder is disposed at a stepped portion of the cylinder where the diameter of the cylinder is changed.

According to a fifth aspect of the present invention, the maximum diameter portion of the agitating projections of the polishing rotor is made of a wear-resistant material which is different from the material of remaining portion thereof.

According to a sixth aspect of the present invention, the agitating projections are inclined at an angle to the vertical axis of the polishing rotor such that the upper parts of the agitating projections has a lag angle in the direction of rotation of the polishing rotor.

According to a seventh aspect of the present invention, each stepped portion of the polishing rotor is stepped at a right angle.

According to an eighth aspect of the present invention, the perforated polishing cylinder has elongated holes a part or all of which are inclined with respect to the direction of rotation of the polishing rotor such that the grain particles are led and thrusted towards the grain discharge section.

In the grain polishing machine in accordance with the first aspect of the present invention, the grain particles fed to the spiral rotor from the grain feed section are fed into the polishing chamber defined mainly by the perforated bran removing polishing cylinder and the polishing rotor so as to be polished. The thus polished grain particles are discharged from the grain discharge section so as to be delivered to a next process station. Meanwhile, the pressure applied to the grain particles is changed as the grain particles pass the portion of the polishing chamber where the polishing cylinder and the polishing rotor are stepped so that a large mixing effect and strong agitating effect are imparted to the grain particles to enable the grain particles to be moved in the polishing chamber, whereby the grain particles are satisfactorily polished in the polishing chamber.

In the grain polishing machine in accordance with the second aspect of the present invention, the grain particles are fed from the lower side of the polishing chamber and are discharged from the upper side of the same.

In the grain polishing machine in accordance with the third aspect of the present invention, the grain particles are compulsorily fed from the grain feed section by means of the grain supply device.

In the grain polishing machine in accordance with the fourth aspect of the present invention, the cross-sectional area of the passage defined by the stepped portions of the polishing cylinder and the polishing rotor is adjusted by the resistance adjusting means so as to control the polishing pressure developed in the polishing chamber.

In the grain polishing machine in accordance with the fifth aspect of the present invention, any deterioration in the polishing performance due to wear of the agitating projections is remarkably suppressed.

In the grain polishing machine in accordance with the sixth aspect of the present invention, an upward thrust or lift is imparted to the grain particles by the polishing rotor provided with inclined agitating projections so that the grain particles are polished with pressure being well-balanced between the upper and lower sections.

In the grain polishing machine in accordance with the seventh aspect of the present invention, the polishing pressure in the polishing chamber is unsmoothly changed due to the presence of the stepped portions.

In the grain polishing apparatus in accordance with the eighth aspect of the present invention, the grain particles are led and thrusted towards the discharge section by virtue of the elongated holes which are provided in the polishing cylinder an inclination.

The invention will be more fully understood from the following description of the preferred embodiments when the same is read in conjunction with the accompanying drawings.

DESCRIPTION OF THE PREFERRED EMBODIMENTS

Figure 1:
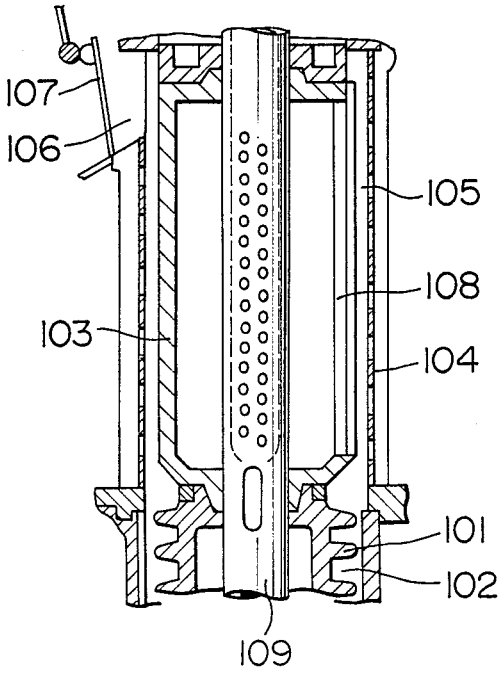
FIG. 1 PRIOR ART
FIG. 1 is an illustration of a conventional grain polishing machine.
Figure 2:
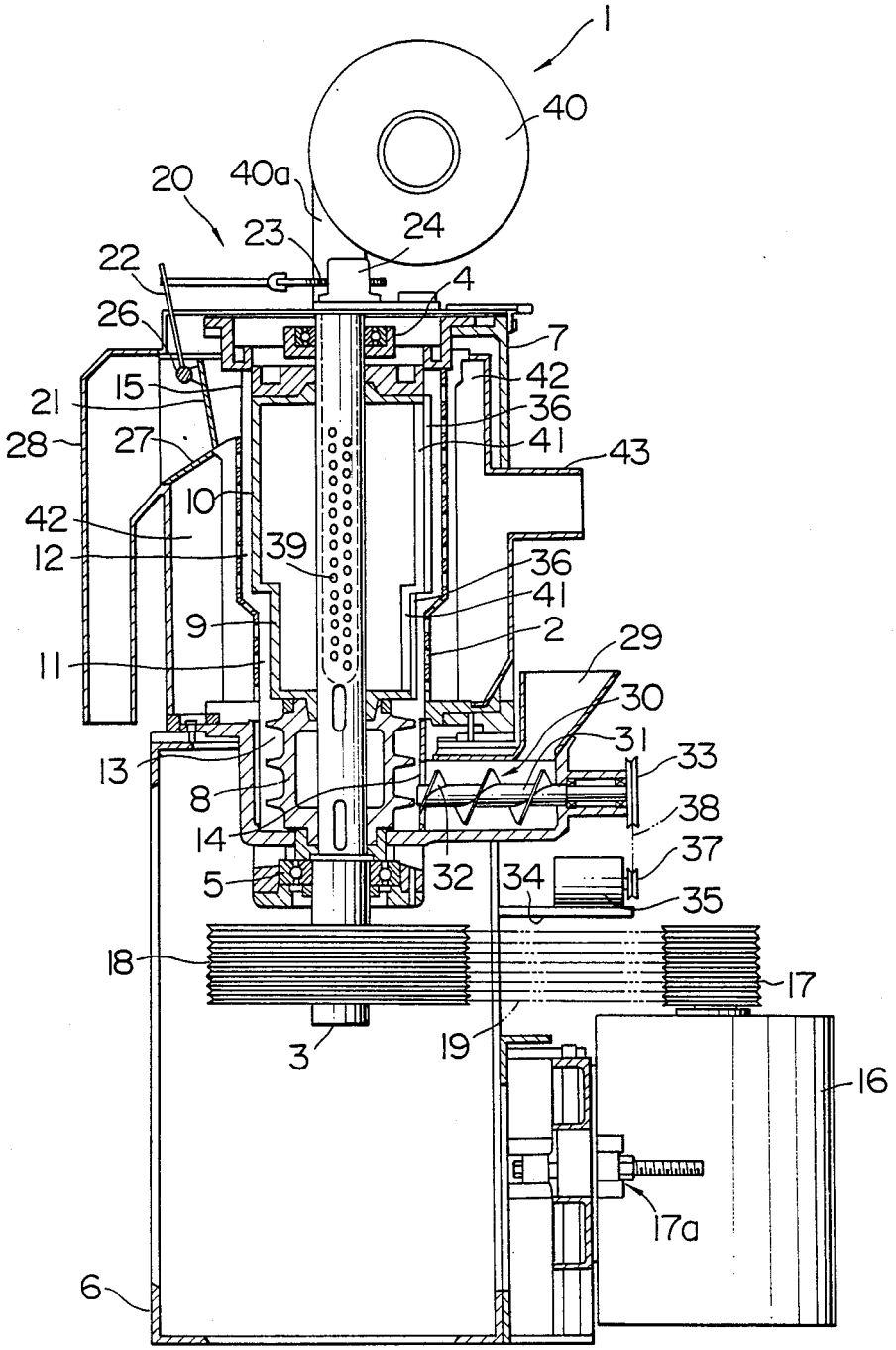
FIG. 2 is a sectional side elevational view of a vertical shaft and friction type grain polishing machine.

FIG. 2 is a sectional side elevational view of a vertical shaft and friction type grain polishing machine of the present invention. The vertical shaft and friction type polishing device of the present invention, which is generally denoted by a numeral 1, has a perforated bran removing polishing cylinder 2 having an upper portion of a larger diameter and a lower portion of a smaller diameter. A main shaft 3 is rotatably disposed in the polishing cylinder 2. The main shaft 3 is rotatably supported at its upper and lower portions through upper and lower bearings 4, 5 on a frame 7 on a base box 6. A spiral rotor 8 is mounted on an intermediate lower portion of the main shaft 3 for rotation therewith. The main shaft 3 also carries, at its portion above the spiral rotor 8, a lower friction polishing rotor 9 and an upper friction polishing rotor 10 which are formed thereon with agitating projections 36.

The perforated bran removing polishing cylinder 2, and the friction polishing rotors 9, 10 in cooperation define a lower polishing chamber 11 and an upper polishing chamber 12. The lower polishing chamber 11 communicates at its lower end portion with a grain feed section 14 through a feed chamber 13 which is defined around the spiral rotor 8. The upper polishing chamber 12 communicates at its upper portion with a discharge section 15. A reference numeral 16 denotes a main motor for driving the vertical shaft and friction type polishing machine. The motor 16 is mounted on the base box 6 by means of mounting means 17*a*.

The motor 16 has a motor pulley 17 which is drivingly connected to the pulley 18 on the main shaft 3 through V-belts 19.

The upper friction polishing rotor 10 has a diameter greater than that of the lower polishing rotor 9 so that a step is formed at the boundary between both polishing rotors 9 and 10. The perforated polishing cylinder 2 surrounds both polishing rotors 9 and 10 so as to define an upper polishing chamber 12 and a lower polishing chamber 11. The perforated polishing cylinder 2 is stepped at a portion thereof corresponding to the step between the upper and lower polishing rollers such that the portion thereof above the step has a greater diameter than the portion thereof below the step. Thus, the upper polishing chamber 12 and the lower polishing chamber 11 are connected indirectly through a connecting portion defined by the steps of the cylinder and polishing rotors.

An automatic resistance adjusting device 20, which is disposed in the discharge section 15, is capable of restraining the grain particles discharged from the discharge section 15 The resistance adjusting device 20 has a resistance plate 21 which is connected to the rack 23 through a lever 22 made of an elastic member. The rack 23 is drivingly connected to a reversible electric motor 24 through a gear train 25, 25', 25'' (see FIG. 3). As the rack 23 moves horizontally by the normal or reversal operation of the servomotor 24, the lever 22 is rotated about the shaft 26 of the resistance plate so that the resistance plate 21 is rotated relatively to the grain discharge section 15.

A conduit 27 is connected to the downstream side of the grain discharge section 15 and a discharge chute 28 is connected to the conduit 27.

A grain supply device 30 connected to a supply hopper 29 has a rotor which is composed of a conveyor shaft 31 and a screw member 32 provided around the conveyor shaft 31. A pulley 33 secured to the conveyor shaft 31 is drivingly connected through a V-belt 38 to a pulley 37 on an electric motor 35 which is provided on a bracket 34 secured to the base box 6. The grain supply device 30 is communicated with the feed section 14.

The main shaft 3 is hollow and is provided with a multiplicity of ventilation ports 39 provided in the portion thereof facing the polishing rotors 9, 10 there around. The hollow cavity of the main shaft 3 is connected to the air outlet 40*a* of a blower device 40. The main shaft 3 is designed to rotate relative to the air discharge end of the air outlet 40*a* of the blower device 40 which faces the main shaft 30, so that a slight gap is left between the end of the air outlet 40*a* and the end of the main shaft 3. The internal cavity of the main shaft 3 is open at its upper end while the lower end thereof is closed. A reference numeral 41 denotes elongated slots provided on the friction polishing rotors 9, 10. A bran removing chamber 42 is connected to a suitable device such as a cyclone through a bran removing duct 43.

Figure 4:
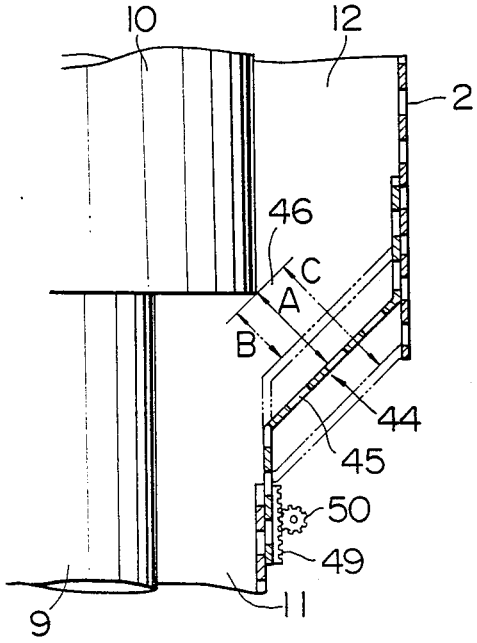
FIG. 4 is an illustration of a resistance adjusting device.

FIG. 4 shows a resistance device 44 for use in connection with the lower polishing chamber 11. The resistance device 44 includes a telescopic structure which is realized by a tapered wall portion between the upper and lower portions of the perforated wall of the polishing cylinder 2, the tapered wall portion being slidable into and out of the upper and lower portions of the cylinder 2. Thus, the tapered wall portion serves as a resistance plate 45 of the resistance device 44 which operates in connection with the lower polishing chamber 11. In operation, the resistance plate 45 is slidingly driven by the actuator of the resistance device 44 so as to vary the cross-sectional area of the connecting portion which interconnects the upper and lower polishing chambers 11 and 12 and which is disposed around the step between the upper and lower polishing rotors 9 and 10, thereby controlling the level of the resistance posed on the flow of the grain particles, thus enabling the polishing pressure in the lower polishing chamber to be adjusted.

The operation of the described polishing machine will be described hereinunder. The grain particles are fed to the grain supply device 30 through the feed hopper 29. As the main electric motor 16 and the electric motor 35 are started, the grain particles are fed to the spiral rotor 8 by means of the screw 32 and are lifted to the lower polishing chamber 11 by the spiral rotor 8. In the lower polishing chamber 11, the grain particles are polished by the polishing action effected by the rotation of the lower friction polishing rotor 9 and are fed into the upper polishing chamber 12 so as to be polished by the upper polishing rotor 10. When the grain particles move from the lower polishing chamber 11 into the upper polishing chamber 12 across the connecting portion as a boundary part therebetween, the grain particles experience a change in the polishing pressure. It is therefore possible to obtain desired levels of polishing pressure in each of the upper and lower polishing chambers 11 and 12, resulting in no abnormal pressure posed to the grain particles, so that any uneven polishing and, hence, undesired discharge of grain particles which have not yet been polished is avoided. Thus, the grain polishing machine of this embodiment exhibits high polishing efficiency and improved polishing performance. The step formed between the lower friction polishing roller 9 and the upper friction polishing roller 10 having a greater diameter than the lower friction polishing roller 9 serves to interrupt or restrict the direct communication between the upper polishing chamber 12 and the lower polishing chamber 11, so that the weight of the grain particles residing in the upper polishing chamber 12 is not directly applied to the grain particles in the lower polishing chamber 11, so that the grain particles in the lower polishing chamber 11 are relieved from any excessive pressure, thus obviating any tendency for the grain particles to be cracked or crushed.

During the operation of the polishing machine, bran removing air is blown from the air nozzle 41 of the blower 41 into the polishing chambers 11 and 12 through the ventilation holes 39, thereby removing bran. Dust containing bran produced in the polishing chambers 11 and 12 during polishing is discharged into the bran removing chamber 42 through the perforations in the perforate bran removing polishing cylinder 2 and is sent to a suitable collecting device such as a cyclone (not shown) through the bran removing chamber 42 and the bran removing duct 43.

The polished grain particles then reach the grain discharge section 15 where the resistance plate 21 of the automatic resistance adjusting device 20 is provided so as to restrict the outcoming flow of the grain particles. As explained before, the degree of polishing is adjustable by the level of the resistance posed by the resistance plate 21. The polished grain particles are forcibly discharged overcoming the pressure posed by the resistance plate 21 to the exterior of the machine through the conduit 27 and the chute 28.

In order to effect optimum polishing of various types of grains, it is necessary that the degree of resistance posed by the resistance adjusting device 20 is varied depending on the types of the grain particles. The upper polishing chamber 12 and the lower polishing chamber 11 are connected through the connecting portion which is restricted due to the presence of the step between the upper and lower polishing rotors 9 and 10, so that the polishing pressure existing in the upper polishing chamber is not directly transmitted to the lower polishing chamber 11. Therefore, any change in the resistance posed by the resistance plate 21 on the outlet end of the upper polishing chamber does not cause any substantial change in the polishing pressure in the lower polishing chamber 11.

Figure 3:
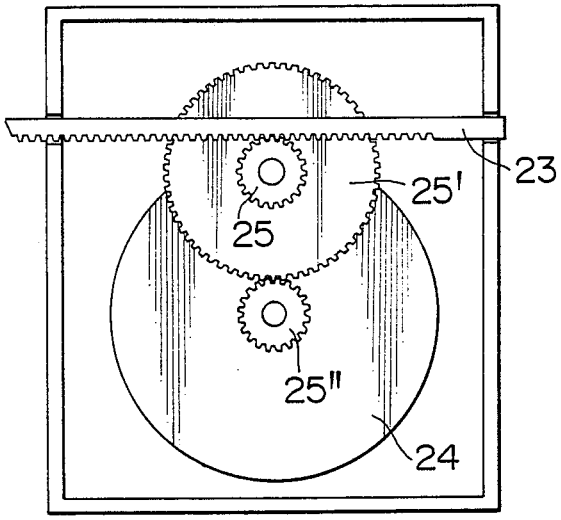
FIG. 3 is a top plan view of an actuator for a resistance plate.
Figure 5:
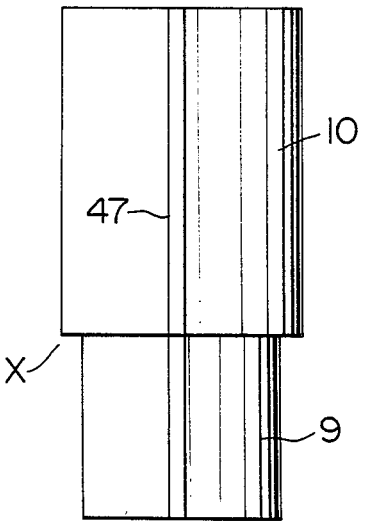
FIG. 5 is a front elevational view of a friction polishing rotor.
Figure 6:
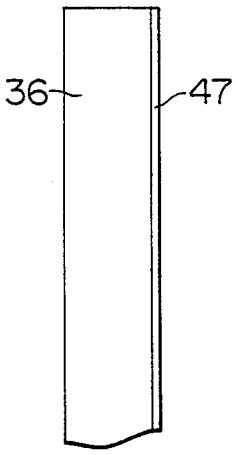
FIG. 6 is a partial side elevational view of agitating projection.
Figure 7:
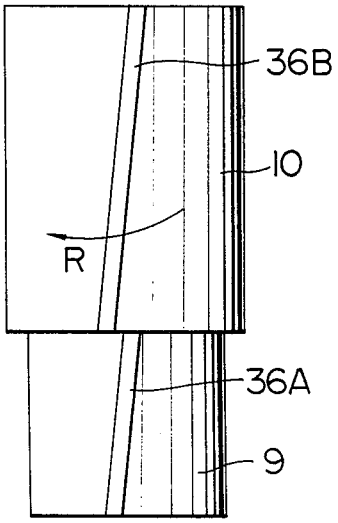
FIGS. 7 and 8 are illustrations of inclined agitating projections.
Figure 8:
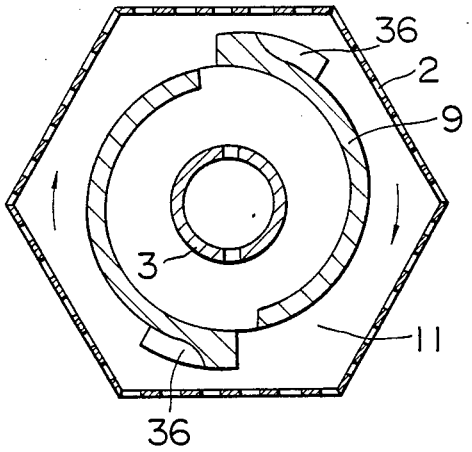

Therefore, the porous resistance plate 45 of the resistance device 44 is moved by an actuating means similar to that shown in FIG. 3, through a rack 49 and a pinion 50, so as to vary the cross-sectional area of a connecting passage 46 in the connecting portion through which the lower and upper polishing chamber 11 and 12 are communicated with each other as shown in FIG. 4, thereby adjusting the polishing pressure in the lower polishing chamber 11. When an ordinary grain is to be polished, the porous wall resistance plate 45 is adjusted to a position where the gap A of the connection passage 46 is obtained. The porous resistance plate 45 is also adjustable to positions B and C, respectively, when polishing a grain which is rather hard to be polished and a grain which is liable to be or crushed. The agitating projections 36 wear as the polishing time becomes long. The wear of the agitating projections tends to impair the agitating effect with the result that the polishing efficiency is seriously lowered. Preferably, a reinforcement member 47 made of a wear-resistant material is therefore secured to each agitating projection 36 as shown in FIGS. 5 and 6, thus preventing rapid wear of the agitating projections. The reinforcement member may be permanently fixed by, for example, welding or may be attached replaceably.

Since each agitating projection is mounted such as to extend in the vertical direction as shown in FIG. 5, there is a tendency that the pressure becomes high in the lower regions of the polishing chambers 11 and 12 and low in the higher regions of these chambers, so that the grain particles are liable to be polished excessively, i.e., ground or crushed, in the lower regions of the respective polishing chambers 11 and 12.

In order to overcome this problem, in the illustrated embodiment, the agitating projections 36A and 36B are inclined at an angle to the axis of the friction polishing rotors 9 and 10 such that the upper end portions of these projections lag as viewed in the direction R of rotation of the friction polishing rotors 9, 10. The grain particles, therefore, are lifted by the agitating projections 36A and 36B against the weight of the grain particles themselves, so that the polishing pressure is well-balanced in the vertical direction in each of the polishing chambers 11 and 12, thus suppressing any tendency of excessive polishing of the grain particles in each polishing chamber.

Since the step X between the upper friction polishing rotor 10 and the lower friction polishing rotor 9 is perpendicular to the axis of these rotor as shown in FIG. 5, the grain particles which move from the lower polishing chamber 11 into the upper polishing chamber 12 experience a large change in the resistance, thereby making it possible to cause a significant change in the polishing pressure applied to the lower polishing chamber 11.

Figure 9:
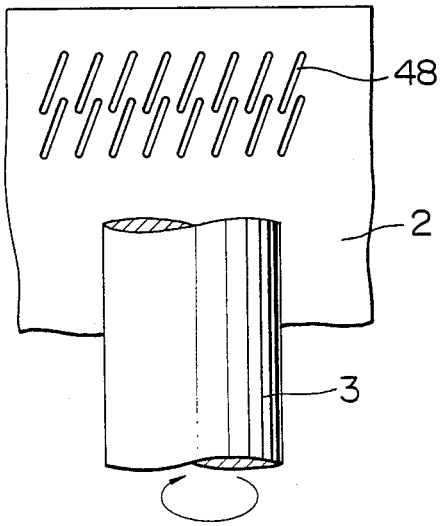
FIG. 9 is an enlarged view of a portion of a polishing cylinder.

As shown in FIG. 9, the multiplicity of holes formed in the wall of the perforated bran removing polishing cylinder 2 are elongated holes 48 which are inclined at a predetermined angle to the direction of rotation of the polishing rotors in such a direction as to lead and thrust the grain particles towards the discharge end. As a result, the elongated holes produce a kind of lifting effect so as to attain a balance of the polishing pressure in the vertical direction, thus avoiding any tendency of excessive polishing, i.e., grinding or crushing, of the grain particles.

In the described embodiment, the polishing rotor is composed of two independent rotors having different diameters, while the polishing cylinder also has upper and lower portions of different diameters. This, however, is only illustrative and the polishing cylinder, as well as the polishing rotor, may have three or more portions of different diameters. In the illustrated embodiment, the upper polishing rotor 10 has a diameter which is greater than that of the lower polishing roller 9. This, however, is not exclusive and the arrangement may be such that the lower polishing rotor 9 has a greater diameter than the upper polishing rotor 10.

In the vertical shaft and friction type grain polishing machine in accordance with the first aspect of the present invention, since each of the perforated polishing cylinder and the polishing rotor is composed of a plurality of portions having different diameters, the grain particles moving from one to another polishing chamber portion across the boundary portion encounter a pressure which temporarily rises in the region around the boundary portion between the polishing chamber portions of different diameters and then drastically decreases. Thus, the grain particles polished in the polishing chamber undergo a variation in the pressure so that they are agitated satisfactorily. In addition, since the polishing rotors of different diameters rotate at the same speed, different peripheral speeds are obtained on the peripheral surfaces of these rotors, whereby different levels of polishing effect are obtained to prevent any uneven polishing and consequent imperfect polishing of the grain particles. In addition, an effective friction polishing effect is produced so as to improve the polishing efficiency.

According to the second aspect of the present invention, the feed section is provided on the lower end of the machine so that, when a plurality of polishing machines are arranged in stages, the grain particles are supplied to the next stage of the polishing machine without necessitating any grain lifting device, thus achieving a remarkable reduction in the installation cost.

According to the third aspect of the present invention, the grain particles are forcibly or compulsorily introduced into the machine by means of the grain supply device, so that the flow of the grain particles entering the machine is rendered steady so as to ensure a stable polishing effect, thereby remarkably increasing the polishing capacity.

According to the fourth aspect of the present invention, the polishing pressure applied to the grain particles in the lower polishing chamber is controlled by means of the resistance device which is capable of adjusting the cross-sectional area of the connecting passage in the boundary between the upper and lower polishing cylinders, thus adapting the grain polishing machine to a variety of types and classes of grains.

According to a fifth aspect of the present invention, the agitating projections are made at least partially from a wear-resistant material so that the agitating projections can stand a long use by preventing the agitating projections from being worn down too soon, thus ensuring a long-lasting high polishing efficiency of the grain polishing machine.

According to the sixth aspect of the present invention, the agitating projections are inclined at an angle to the direction of the axis of the polishing rotor such that the downstream portion of the agitating projection lags as viewed in the direction of rotation of the rotor, so that the polishing pressure is well-balanced in the vertical direction so as to prevent any crushing of the grain particles which may otherwise be caused due to locally abnormal increase in the polishing pressure.

According to a seventh aspect of the present invention, the step of the polishing rotor is formed substantially perpendicularly to the axis of the polishing rotor so that the grain particles moving across the step encounter a drastic change in the pressure. This step also facilitates adjustment of pressure in each polishing chamber.

According to an eighth aspect of the present invention, the elongated holes formed in the wall of the perforated bran removing polishing chamber are inclined with respect to the direction of rotation of the polishing rotor such that these holes lead and thrust the grain particles towards the discharge side. Therefore, these holes provide a lifting effect on the grain particles so that balance of the polishing pressure is attained in the vertical direction in each of the polishing chamber portions thereby to eliminate any tendency for the grain particles to be excessively polished or ground, thus preventing any reduction in the yield which may otherwise be caused by the excessive polishing.

What is claimed is:

1. A grains polishing machine of vertical friction type in which a main shaft is rotatably arranged within a vertical perforated bran-removing polishing cylinder, the main shaft has thereon a spiral rotor and a polishing rotor, said polishing rotor having a vertical axis and agitating projections, and a polishing chamber defined between said perforated bran-removing polishing cylinder and the polishing rotor which communicates at one end of said chamber with a grain feed section and at the other end of said chamber with a grain discharge section, wherein said polishing cylinder is axially divided into at least two sections different in diameter from each other so as to have a step part therebetween and said polishing rotor is also axially divided into at least two sections different in diameter from each other so as to have a step part therebetween, whereby said polishing chamber is axially divided into at least two sections so as to have a corresponding connection passage therebetween which communicates such chamber sections with each other, said connection passage being defined between the respective step parts of said perforated bran-removing polishing cylinder and said polishing rotor, and said connection passage being provided with a resistance adjusting means for adjusting the cross-sectional area of said connection passage.

2. A grain polishing machine as set forth in claim 1, wherein said grain feed section is formed at the lower end of said polishing chamber.

3. A grain polishing machine as set forth in claim 2, wherein a grain supply device for compulsorily feeding said grain is disposed upstream of said grain feed section.

4. A grain polishing machine as set forth in claim 1, wherein said agitating projections each have a maximum diameter part which is made of a wear resistant material different from the material of the remaining part thereof.

5. A grain polishing machine as set forth in claim 2, wherein said agitating projections are inclined so that the upper parts of said agitating projections have a lag angle in the direction of said polishing rotor with respect to the vertical axis of latter.

6. A grain polishing machines as set forth in claim 1, wherein said step part formed in said rotor is a right angle step part.

7. A grain polishing machine as set forth in claim 2, wherein said polishing cylinder has elongated holes which are formed therein and which are inclined with respect to the rotating direction of said polishing rotor so that the grain is led and thrusted toward said grain discharge section.

* * * * *